US008016694B2

(12) United States Patent
Llewellyn et al.

(10) Patent No.: US 8,016,694 B2
(45) **Date of Patent: *Sep. 13, 2011**

(54) GOLF CLUB HEAD AND GOLF CLUBS

(75) Inventors: David Llewellyn, Duluth, GA (US); Tetsuya Kanayama, Osaka (JP); Masao Nagai, Hyogo (JP)

(73) Assignee: Mizuno USA, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/610,332

(22) Filed: Nov. 1, 2009

(65) Prior Publication Data

US 2011/0009209 A1 Jan. 13, 2011

Related U.S. Application Data

(63) Continuation-in-part of application No. 11/673,802, filed on Feb. 12, 2007, now Pat. No. 7,611,424, and a continuation of application No. 29/339,723, filed on Jul. 7, 2009, now Pat. No. Des. 617,858.

(51) Int. Cl.
*A63B 53/04* (2006.01)
*A63B 53/06* (2006.01)

(52) U.S. Cl. ..... 473/334; 473/335; 473/338; 473/345; 473/349

(58) Field of Classification Search ..... 473/324–350, 473/287–292, 256; D21/733, 752, 759
See application file for complete search history.

(56) References Cited

U.S. PATENT DOCUMENTS

| | | | | |
|---|---|---|---|---|
| 2,155,830 | A * | 4/1939 | Howard | 473/246 |
| 2,460,445 | A | 2/1949 | Bigler | |
| 2,652,256 | A | 9/1953 | Thomas | |
| 3,995,857 | A | 12/1976 | Cochran et al. | |
| 4,008,896 | A * | 2/1977 | Gordos | 473/336 |
| 4,027,881 | A | 6/1977 | Hufenus | |
| 4,085,934 | A | 4/1978 | Churchward | |
| D275,412 | S | 9/1984 | Simmons | |
| 4,530,505 | A | 7/1985 | Stuff | |
| 4,895,371 | A | 1/1990 | Bushner | |
| 5,282,625 | A | 2/1994 | Schmidt et al. | |
| 5,447,309 | A | 9/1995 | Vincent | |

(Continued)

FOREIGN PATENT DOCUMENTS

CA 2553362 A1 2/2007

(Continued)

OTHER PUBLICATIONS

European Patent Office Search Report for EP Application No. 08002354.2 dated May 27, 2008.

(Continued)

*Primary Examiner* — Sebastiano Passaniti
(74) *Attorney, Agent, or Firm* — Troutman Sanders LLP; James E. Schutz; Robert R. Elliot, Jr.

(57) ABSTRACT

A golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight. Other aspects, features, and embodiments are also claimed and described.

20 Claims, 6 Drawing Sheets

U.S. PATENT DOCUMENTS

| | | | | |
|---|---|---|---|---|
| 5,769,737 | A | 6/1998 | Holladay et al. | |
| 5,776,010 | A | 7/1998 | Helmstetter et al. | |
| 5,785,605 | A | 7/1998 | Helmstetter | |
| 5,785,609 | A | 7/1998 | Sheets et al. | |
| 5,967,905 | A | 10/1999 | Nakahara et al. | |
| 5,971,867 | A | 10/1999 | Galy | |
| 5,989,134 | A | 11/1999 | Antonious | |
| 6,015,354 | A | 1/2000 | Ahn et al. | |
| D426,268 | S | 6/2000 | Ortiz | |
| 6,077,171 | A | 6/2000 | Yoneyama | |
| 6,126,556 | A | 10/2000 | Hsieh | |
| 6,206,790 | B1 | 3/2001 | Kubica et al. | |
| 6,210,290 | B1 | 4/2001 | Erickson et al. | |
| 6,217,461 | B1 | 4/2001 | Galy | |
| 6,277,032 | B1 | 8/2001 | Smith | |
| 6,364,788 | B1 | 4/2002 | Helmstetter et al. | |
| 6,379,264 | B1 | 4/2002 | Forzano | |
| 6,409,612 | B1 | 6/2002 | Evans et al. | |
| 6,440,009 | B1 | 8/2002 | Guibaud et al. | |
| D471,246 | S | 3/2003 | Jones et al. | |
| 6,551,200 | B1 | 4/2003 | Golden et al. | |
| 6,554,719 | B2 | 4/2003 | Peters et al. | |
| 6,554,721 | B1 | 4/2003 | Woodward et al. | |
| 6,558,271 | B1 | 5/2003 | Beach et al. | |
| 6,592,468 | B2 | 7/2003 | Vincent et al. | |
| 6,623,378 | B2 | 9/2003 | Beach et al. | |
| 6,648,772 | B2 | 11/2003 | Vincent et al. | |
| 6,719,642 | B2 | 4/2004 | Wahl et al. | |
| 6,719,644 | B2 | 4/2004 | Beach | |
| D490,488 | S | 5/2004 | Hoffmann et al. | |
| 6,739,983 | B2 | 5/2004 | Helmstetter et al. | |
| 6,773,360 | B2 | 8/2004 | Willett et al. | |
| 6,800,038 | B2 | 10/2004 | Willett et al. | |
| D498,508 | S | 11/2004 | Antonious | |
| 6,811,496 | B2 | 11/2004 | Wahl et al. | |
| 6,814,673 | B2 | 11/2004 | Wahl et al. | |
| 6,860,818 | B2 | 3/2005 | Mahaffey et al. | |
| 6,955,610 | B1 | 10/2005 | Czaja et al. | |
| 7,147,573 | B2 | 12/2006 | DiMarco | |
| 7,166,040 | B2 | 1/2007 | Hoffman et al. | |
| 7,166,041 | B2 * | 1/2007 | Evans | 473/334 |
| 7,186,190 | B1 | 3/2007 | Beach et al. | |
| 7,201,669 | B2 | 4/2007 | Stites et al. | |
| D552,701 | S | 10/2007 | Ruggiero et al. | |
| 7,452,286 | B2 | 11/2008 | Lin et al. | |
| D585,101 | S | 1/2009 | Glod | |
| D602,544 | S | 10/2009 | Oldknow | |
| D602,545 | S | 10/2009 | Oldknow | |
| 7,611,424 | B2 * | 11/2009 | Nagai et al. | 473/334 |
| D617,858 | S * | 6/2010 | Llewellyn et al. | D21/752 |
| 2003/0232659 | A1 | 12/2003 | Mahaffey et al. | |
| 2004/0176177 | A1 | 9/2004 | Mahaffey et al. | |
| 2005/0137024 | A1 | 6/2005 | Stites et al. | |
| 2005/0227780 | A1 | 10/2005 | Cover et al. | |
| 2006/0122004 | A1 | 6/2006 | Chen et al. | |
| 2006/0172821 | A1 * | 8/2006 | Evans | 473/349 |
| 2006/0178228 | A1 | 8/2006 | DiMarco | |
| 2006/0240908 | A1 | 10/2006 | Adams et al. | |
| 2007/0178988 | A1 | 8/2007 | Tavares et al. | |
| 2007/0225085 | A1 | 9/2007 | Koide et al. | |
| 2007/0238551 | A1 | 10/2007 | Yokota | |
| 2008/0020861 | A1 | 1/2008 | Adams et al. | |
| 2008/0146370 | A1 | 6/2008 | Beach et al. | |
| 2008/0261715 | A1 | 10/2008 | Carter | |

FOREIGN PATENT DOCUMENTS

| | | | |
|---|---|---|---|
| JP | 64043278 | A | 2/1989 |
| JP | 06238022 | A | 8/1994 |
| JP | 08191907 | A | 7/1996 |
| JP | 09028844 | A | 2/1997 |
| JP | 3109501 | U | 5/2005 |
| WO | 2007101350 | | 9/2007 |

OTHER PUBLICATIONS

European Patent Office Examination Report for EP Application No. 08002354.2 dated Mar. 5, 2009.

* cited by examiner

GOLF CLUB HEAD AND GOLF CLUBS

CROSS REFERENCE TO RELATED APPLICATION & PRIORITY CLAIM

This patent application claims priority to and is a continuation in part of U.S. Non-Provisional patent application Ser. No. 11/673,802, filed 12 Feb. 2007, and entitled "Golf Club Head and Golf Club," which is incorporated herein by reference as if fully set forth below in its entirety. This patent application is also a continuation of U.S. Design Pat. No. 29/339,723, filed 7 Jul. 2009, and entitled "Design for Driver-type Golf Club," which is incorporated herein by reference as if fully set forth below in its entirety.

TECHNICAL FIELD

Embodiments of the present invention relate generally to a golf club head and, more particularly, to a wood-type golf club head having one or more adjustable weights.

BACKGROUND

Current driver and fairway wood golf club heads are typically formed of steel or titanium alloys. For example, oversize driver heads exceeding 300 cc in volume are usually formed of a lightweight titanium alloy such as Ti 6A1-4V. Unless modified, oversize heads can have a relatively high center of gravity, which can adversely affect launch angle and flight trajectory of a golf ball. Thus, many club heads have integral sole weight pads cast into the head at a predetermined location to lower the club's center of gravity. Also, epoxy may be later added through the hosel to obtain a final desired weight of the club head. Alternatively, club heads may have weights, usually of a higher density material than the titanium or steel alloy, externally attached to the sole. The weights may be welded in place or attached using a fastener such as a screw. Because of the repeated contact with the ground during the golfer's swings, use of an adhesive alone is not advised as a long term, external attachment method for a weight. These weights are of a prescribed amount and are attached prior to purchase. However, the club's weighting typically is set for a standard, or ideal, swing type. Thus, even though the weight may be too light or too heavy, or too far forward or too far rearward, golfers cannot adjust or customize the club weighting to their particular swing.

Previous attempts to solve these issues have resulted in golf club heads with removable weights. For example, U.S. Pat. No. 6,860,818 to Mahaffey discloses a golf club head that includes weights that can be removed from the club head and replaced with heavier or lighter weights depending on the desired configuration of the user. However, the weights shown in Mahaffey are completely removable from the club head by the user and can therefore be easily lost or misplaced by the user.

It should, therefore, be appreciated that there is a need for a golf club head that allows a golfer to fine tune the weight of the club head for his or her swing. Embodiments of the present invention fulfill this need and others.

BRIEF SUMMARY OF EXEMPLARY EMBODIMENTS

Disclosed herein is a golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight.

In accordance with some embodiments, a golf club head of the wood-type can generally comprise a body, an elongated groove, and one or more weights. The body can comprise a ball-striking face, a sole, a crown, and a ribbon extending rearwardly from the face. The elongated groove can extends along a portion of the ribbon. The elongated groove can define a series of continuous recesses disposed on an inner surface of the elongated groove. The elongated groove can comprise a series of connected portions defining a multi-dimensional track. The one or more weights can be slidably disposed in the elongated groove. The one or more weights can be configured to slidably engage the multi-dimensional track so the one or more weights slide about the multi-dimensional track and engage one of the recesses.

Golf club embodiments can also include additional features. For example, a golf club can comprise a fastener affixed to the one or more weights capable of selectively fixing a location of the weights, wherein the series of recesses disposed on the inner surface are operable to receive the fastener. The series of connected portions can define the multi-dimensional track; and the track can comprise two opposing, spaced apart portions extending away from each other toward the ball-striking face. In some embodiments, the series of connected portions can define the multi-dimensional track that comprises a middle portion that connects the two opposing, spaced apart portions to form a continuous elongated groove. Also, the multi-dimensional track can be configured so that the one or more weights disposed in the track can be moved in a first dimension between the ball-striking face and a back portion of the club and in a second dimension between a toe portion and a heel portion of the club. The series of continuous recesses can comprise surfaces to receive a fastener associated with the one or more weights, wherein the surfaces are equally spaced apart along the recess. In some embodiments, the elongated groove can have a dovetail shape. The one or more weights can have a complementary shape enabling the elongated groove to hold the one or more weights in the groove. The golf club can also comprise a receiving slot operable to receive the one or more weights and insert the one or more weights into the elongated groove. The receiving slot can be located at a location along the elongated groove that is proximate a heel portion of the club. Also, in some embodiments, a golf club can comprise a removable stop disposed in the receiving slot that prevents the one or more weights from leaving the elongated groove.

In other embodiments of the present invention, a golf club head of the wood-type can generally comprise a body and an elongated groove. The body can define an interior cavity and including a ball-striking face, a sole, a crown, and a ribbon disposed rear of the ball-striking face. The elongated groove can be disposed on a portion of the ribbon. The elongated groove can include a plurality of continuous recesses disposed on an inner surface of the elongated groove. The elongated groove can comprise extension portions having ends that extend away from each other toward the ball-striking face and are separated by the sole. The elongated groove can be configured to carry one or more weights in slidable arrangement. The one or more weights can be slidably disposed in the elongated grove. The groove can be configured to receive the one or more weights in a unique one of the continuous recesses so that placement of the one or more weights along the groove enables adjustment of mass properties of the club.

Golf club embodiments of the present invention can also include additional features. As an example, golf clubs can comprise a fastener affixed to each of the one or more of weights. Fasteners can comprise an end portion configured to be received into the continuous recesses such that a location of the weights can be fixed along the elongated groove. In some embodiments, elongated grooves can comprise a joining section to join the extension portions. The joining section can be disposed at a location away from the ball-striking face and near a heel section of the golf club. The elongated groove can be configured as a multi-dimensional track configured to allow placement of the weights in a first dimension between the ball-striking face of the club and a back portion of the club and in a second dimension between a heel portion and a toe portion of the club. The elongated groove and the one or more weights can be configured with corresponding shapes so that the elongated groove can carry the one or more weights and the one or more weights can slidably traverse corner portions of the elongated groove.

Track recesses can have several advantageous features according to embodiments of the present invention. The plurality of continuous recesses can be spaced evenly along the elongated groove at discrete locations. The recesses can comprise opposing wall surfaces enabling placement of the one or more weights at the discrete locations. The recesses can be positioned at discrete locations in the groove. The recesses can be configured to receive fasteners associated with the one or more weights such that placement of the one or more weights remains constant when fastened in the plurality of recesses.

Still yet in other embodiments, the present invention can be a golf club head having a body defining a ball-striking face, a sole, a crown, and a ribbon portion having an adjustable weight golf club system. The adjustable weight golf club system can be configured to enable a user to adjust position of one or more weights disposed proximate the ribbon portion. Doing so enables a user to adjust mass properties of the golf club.

An adjustable weight golf club system can generally comprise a groove and a plurality of recesses. The groove can be generally positioned proximate a ribbon portion of a golf club and extending along at least a portion of the ribbon. The groove can comprise opposed groove walls and a groove inner surface. The groove walls can be configured to extend from the groove inner surface to define a groove opening. Recesses can be disposed in the groove and located on the groove inner surface. Recesses can comprise opposing sloped walls. The groove can be configured to carry at least one weight adapted for lockable engagement with a unique one of the plurality of recesses. Such a configuration enables a user can the ability to lockably position at least one weight along the groove to adjust mass properties of the golf club. Adjustable weight club embodiments can also include additional features. For example, the groove being configured as a multidimensional track so that one or more weights in the track can be positioned at a location along a first dimension between ball-striking face and back portions of the golf club and along a second dimension between hell and toe portions of the golf club. Also, recesses are spaced evenly along the groove and configured to position the at least one weight at a predetermined position in the elongated groove. Also, the weights can be sized and shaped to have a complimentary cross section as the groove, the at least one weight having opposed ends extending toward the opposed groove walls to snugly fit within the groove.

The foregoing and other objects, features, aspects and advantages of the present invention will become more apparent from the following detailed description of the present invention when taken in conjunction with the accompanying drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains currently preferred and alternative embodiments of the invention, together with advantages and features, by way of example with reference to the drawings.

DETAILED DESCRIPTION OF EXEMPLARY & ALTERNATIVE EMBODIMENTS

Disclosed herein is a golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight.

As discussed herein, embodiments of the present invention can include an elongated groove formed in the underside exterior surface of the golf club. The elongated track can be in the shape of a track having two diagonal portions connected with straight portion, thereby forming a general _/-shape (sometimes referred to herein as a general V-shape or trough shape). A general V-shape trough with diagonal extensions enables one or more weights to be moved along multiple spatial dimensions. Advantageously, such movement enables a user to tailor center of gravity and moment of inertia characteristics of a golf club thereby enabling control of ball flight height trajectory and ball draw/fade direction. As a result, elongated tracks formed in golf club embodiments of the present invention enable multi-biasing features.

Figure 1:
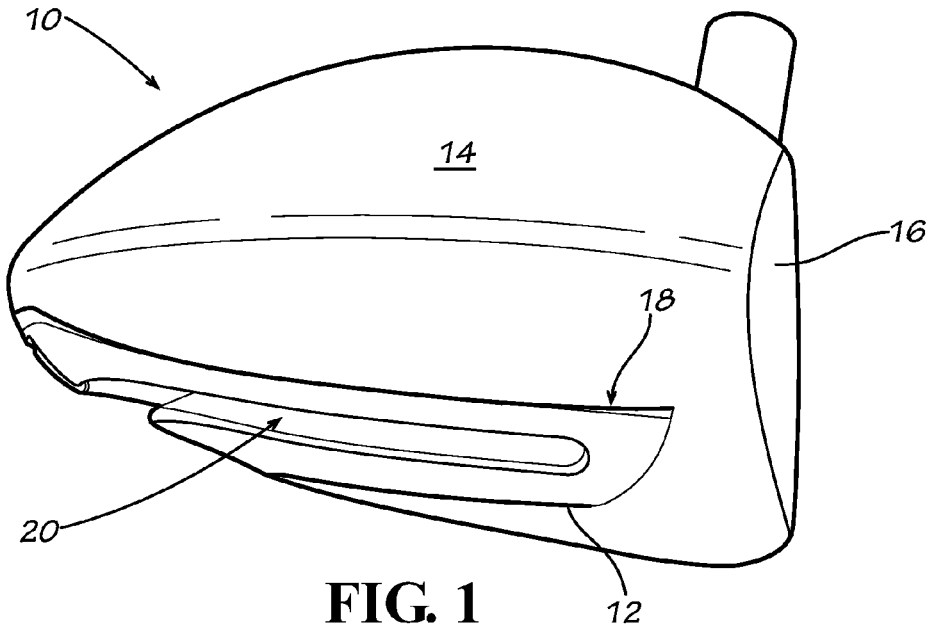
FIG. 1 is illustrates a bottom perspective view of a wood-type golf club head in accordance with some embodiments of the present invention.
Figure 2:
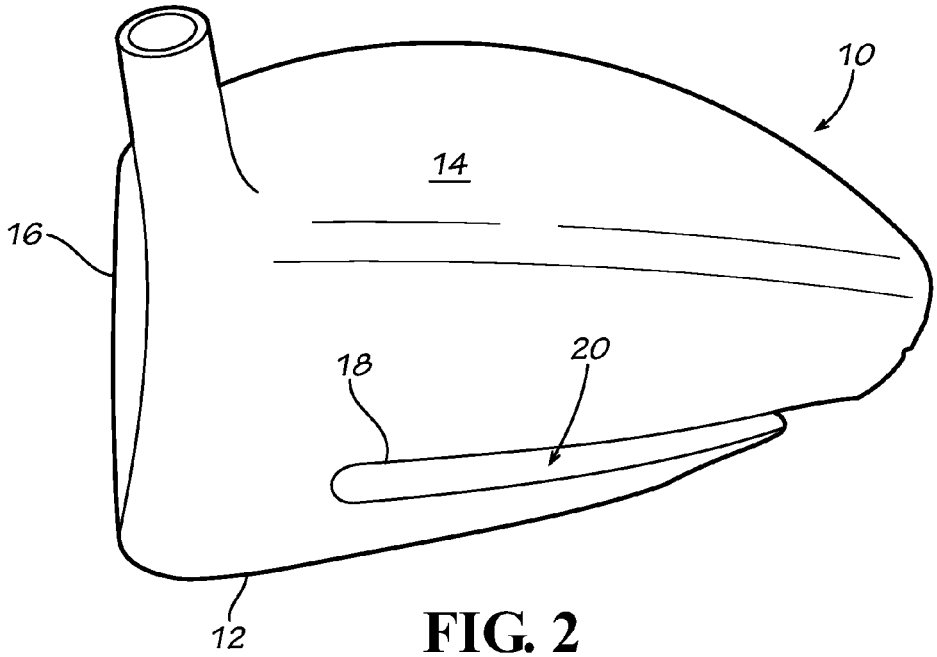
FIG. 2 illustrates another bottom perspective view of a wood-type golf club head in accordance with some embodiments of the present invention.

Referring now to FIGS. 1 and 2, a golf club head 10 in accordance with an exemplary embodiment is illustrated. The club head 10 is of the wood type, and is preferably a metal wood including a body and hosel. In exemplary embodiments, the club head 10 can be formed in a conventional manner, such as welding components together as is known in the art. The club head 10 includes a sole 12, a crown 14, a ball-striking face 16, and a ribbon 18 extending rearwardly from the ball-striking face 16. The ribbon 18 includes an elongated groove 20 that extends along a portion of the ribbon 18. In exemplary embodiments, the elongated groove 20 may be located on a lower portion of the ribbon 18. The elongated groove 20 may extend around the entire ribbon 18, from the heel to the toe of the club head 10, or any portion thereof.

Figure 3:
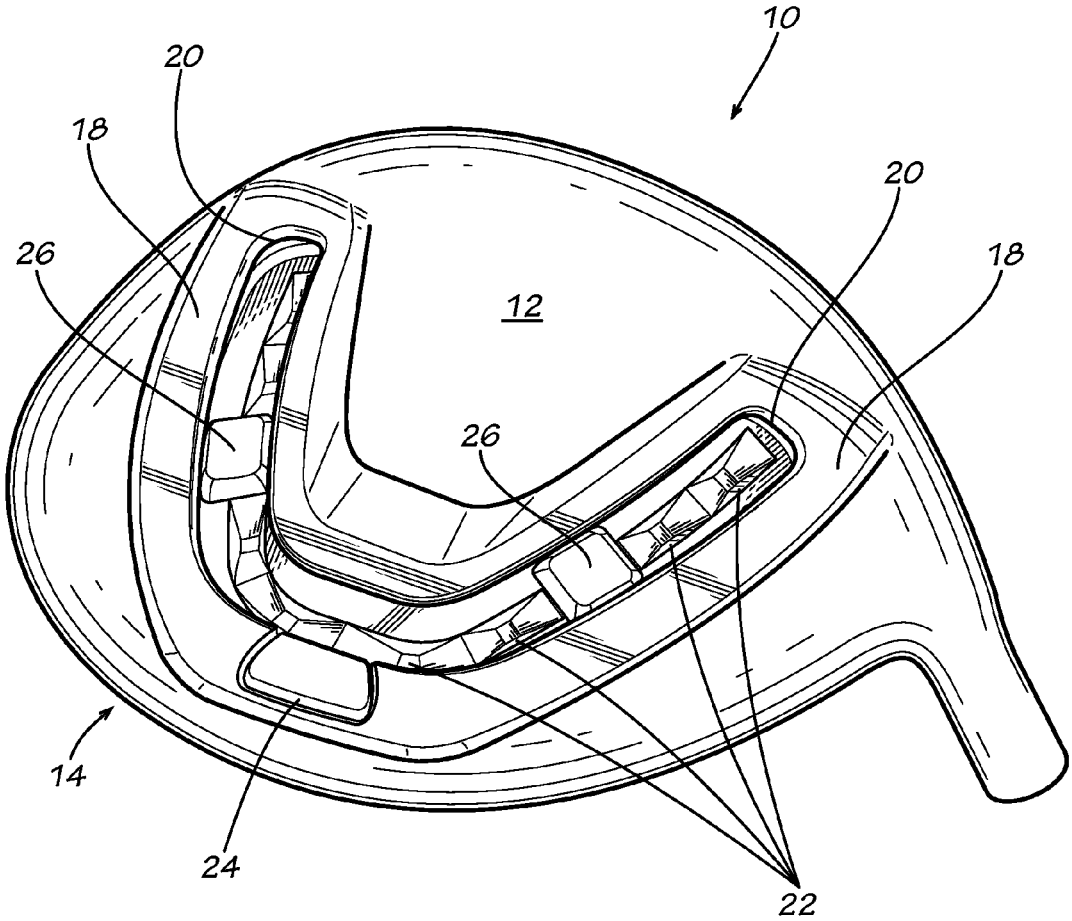
FIG. 3 is a perspective side view of a wood-type golf club head in accordance with some embodiments of the present invention.
Figure 4:
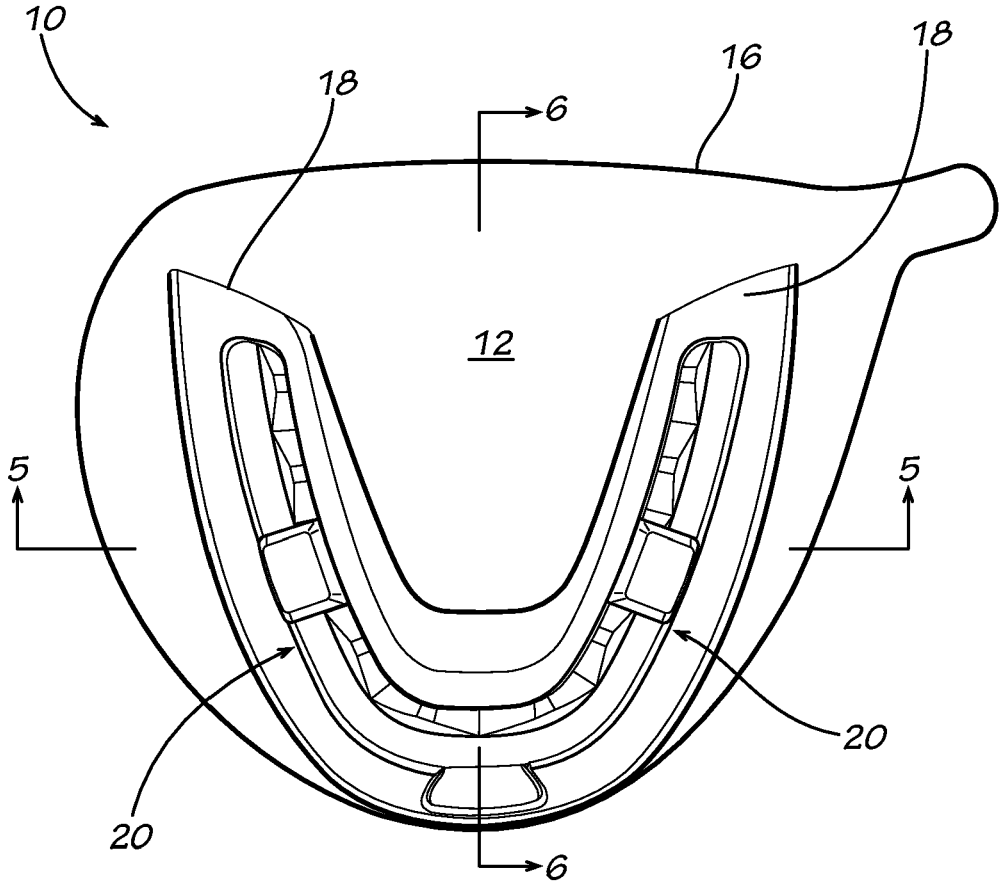
FIG. 4 is a perspective side view of a wood-type golf club head in accordance with some embodiments of the present invention.

Turning now to FIGS. 3-4, a perspective view of the bottom of the club head 10 is illustrated. As shown, the elongated groove 20 includes a plurality of recesses 22 disposed on an inner surface of the elongated groove 20. The recesses 22 may be of varying width and depth and may be spaced evenly along the elongated groove 20. In an exemplary embodiment, the recess 22 may be sloped on both sides to guide the weight to a predetermined position in the elongated groove 20. A receiving slot 24 is located adjacent to one end of the elongated groove 20 and the receiving slot 24 has an aperture larger than the outer portion of the elongated groove 20. The elongated groove 20 is designed to house one or more weights 26 that can be repositioned by a user. The number of weights 26 in the elongated groove 20 is less than the number of recess 22 disposed along the inner portion of the elongated groove 20. In one embodiment, the weights 26 are inserted into the elongated groove 20 through the receiving slot 24 by the manufacture of the club such that the weights are not removable from the elongated groove 20.

Continuing with reference to FIGS. 3-4, the weights 26 is slidably disposed in the elongated groove 20. In addition, the receiving slot 24 includes a stop that is positioned in the receiving slot 24 to prevent the weights 26 from being removed from the elongated groove 20. The weights 26 includes a fastener 30 that is designed to selectively fix the position of the weights 26 in the elongated groove. In an exemplary embodiment, the fastener 30 is a bolt that extends through the weights 26 and engages one of the recesses 22 on the inner surface of the elongated groove 20. The fastener 30 is designed to prevent the weights 26 from moving in the elongated groove 20 during the swinging of the golf club during which the weights 26 can be subjected to several strong forces.

In exemplary embodiments, the club head 10 may include a plurality of weights 26 that are slidably disposed in the elongated groove 20. The weights 26 are inserted into the elongated groove 20 through the receiving slot 24 and a stop is placed in the receiving slot 24 to prevent the weights 26 from being removed from the elongated groove 20. The weights 26 can be placed in a uniform weight distribution pattern in the elongated groove 20 or in a variable distribution so that more weight can be provided in a particular region of the club head 10, either rearwardly or more toward the toe or heel portion as desired. In exemplary embodiments, the weights 26 can be formed of any material such as metal or fiber reinforced plastic.

Figure 5:
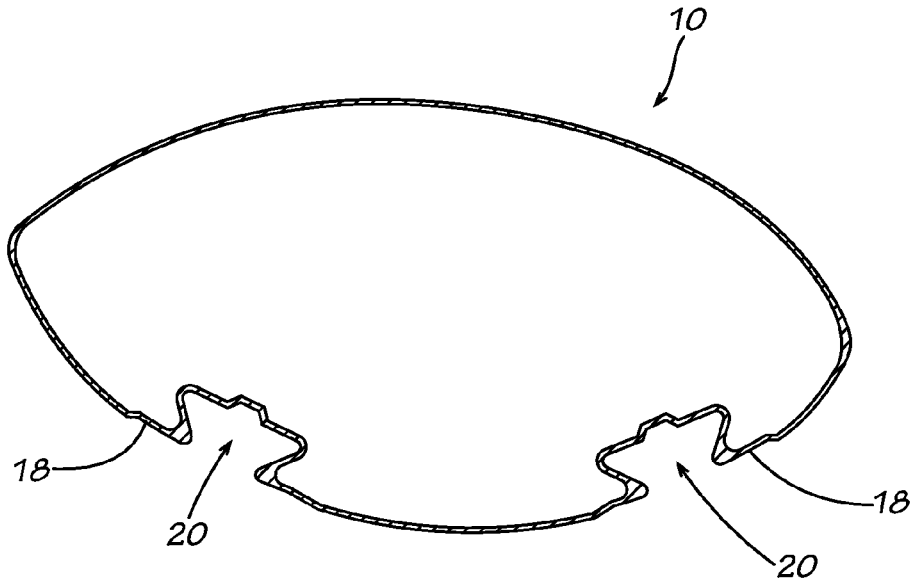
FIG. 5 is a cross-sectional view of a wood-type golf club head in accordance with some embodiments of the present invention.
Figure 6:
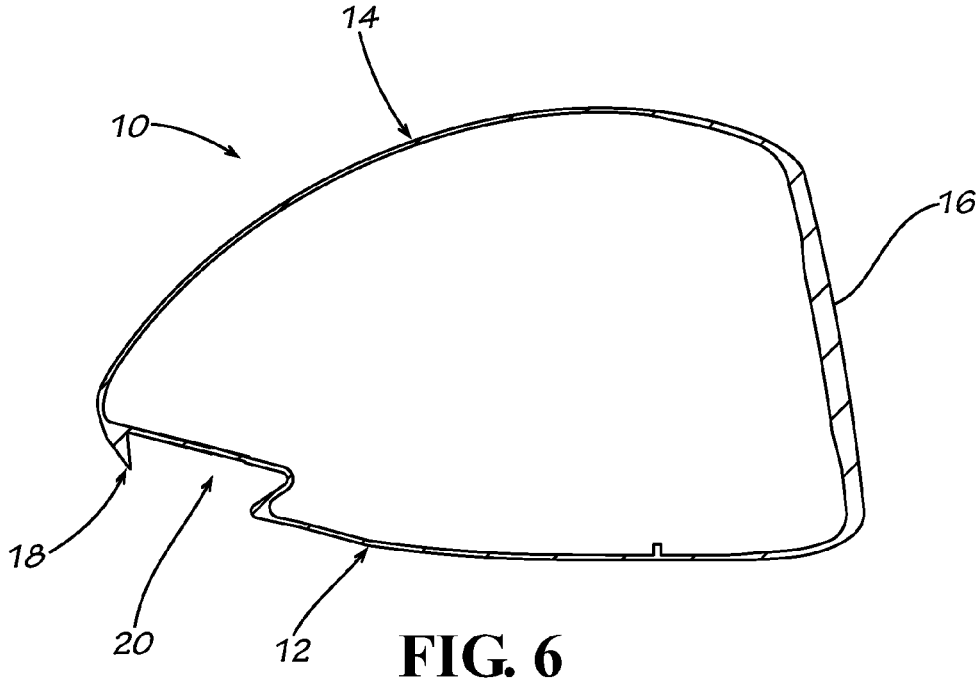
FIG. 6 is another cross-sectional view of a wood-type golf club head in accordance with some embodiments of the present invention.

Turning now to FIGS. 5-6, cross sectional views of the club head 10 are illustrated. As shown, the elongated groove 20 may have a dovetail shape that is designed to allow the weights 26 to freely slide in the elongated groove 20 but prevent the weights 26 from coming out of the elongated groove 20. In other exemplary embodiments, the elongated grove 20 may have another suitable shape. The weights 26 may have a shape designed to be at least partially complementary to the shape of the elongated groove 20. Additionally, the one or more weights 26 may all have the same mass or different masses. For example, three weights 26 may be disposed in the elongated groove 26 and the outer two weights may have the same mass while the central weight has a different mass.

Figure 7:
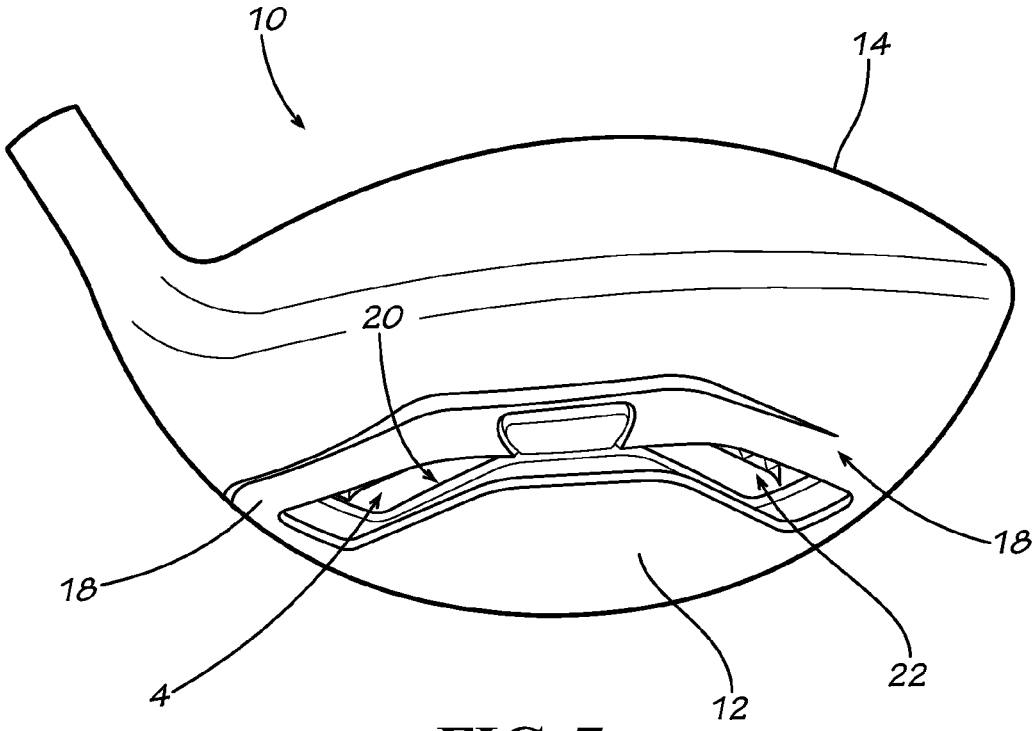
FIG. 7 is a rear perspective view of a wood-type golf club head in accordance with some embodiments of the present invention.

FIG. 7 is a rear perspective view of a wood-type golf club head in accordance with some embodiments of the present invention. By changing the location of the weights 26 in the elongated groove 20 the user can effectively change the performance of the club head 10. For example, an increased toward the rear of the club head provides a higher trajectory to a ball struck by the club. As another example, an increased weight toward the face of the club head provides a lower trajectory to a ball struck by the club. In addition, placement of the weights 26 in a rear to front location is also advantageous in controlling ball speed and spin. As shown in FIG. 7, the extension arms 21, 22 of the groove 20 has multi-spatial movement (side to side and rear to front of the club) that enables weight placement to configure bias club characteristics. Peripheral weighting increases the moment of inertia and the resistance to rotation of the club, particularly when a ball is struck outside the center of the striking face.

Figure 8:
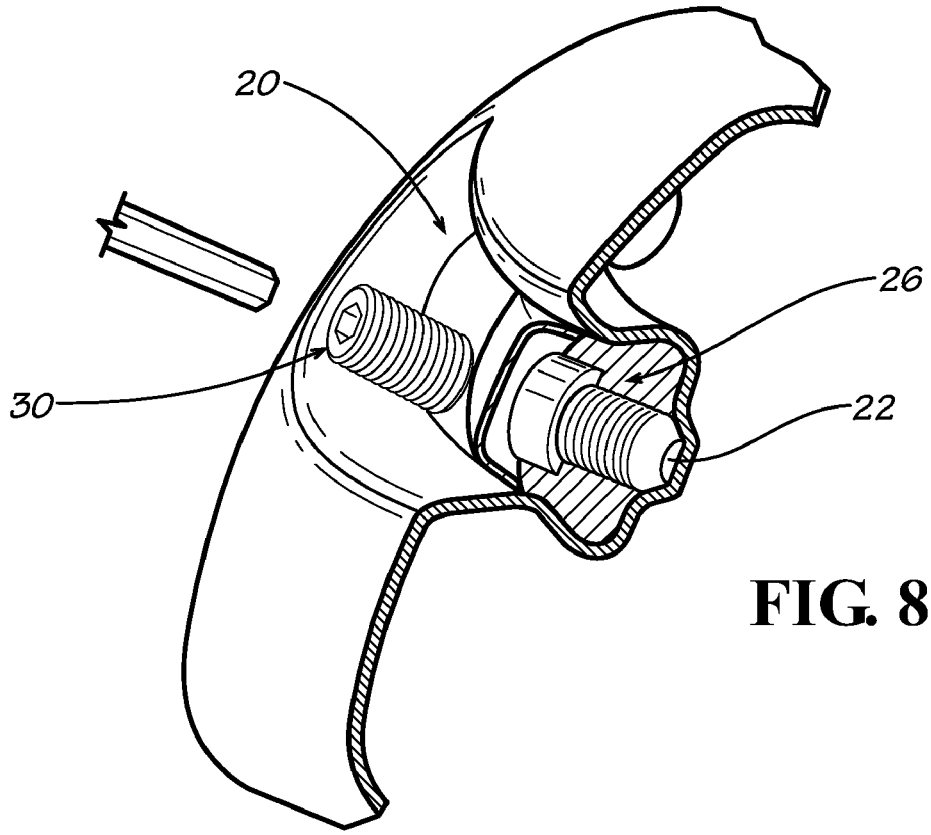
FIG. 8 is a cross sectional view of a spring bolt fastener system in accordance with some embodiments of the present invention.
Figure 9:
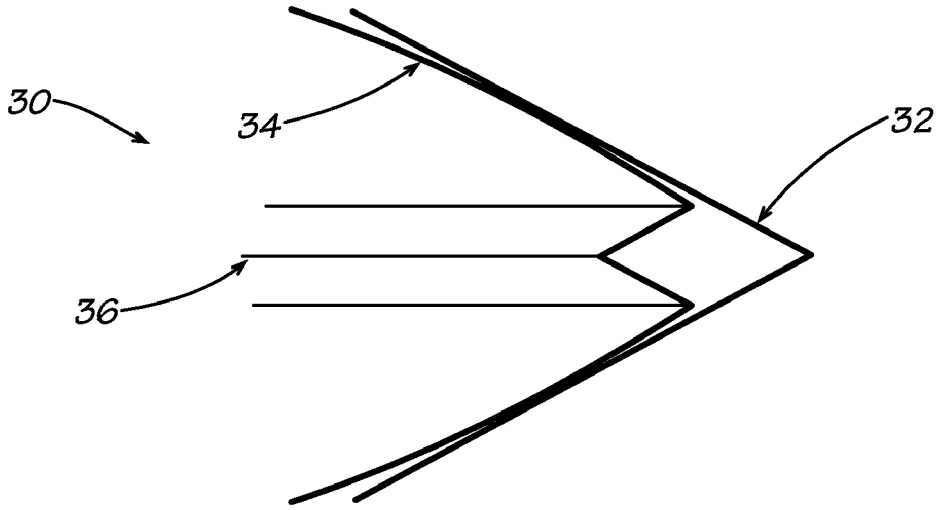
FIG. 9 is a cross-sectional view of a spring bolt in accordance with some embodiments of the present invention.

Referring now to FIGS. 8-9 a cross sectional view of a portion of the wood-type golf club head 10 and the fastener 30 are show, respectively. The fastener 30 is designed to affix the location of the weight 26 in the elongated groove 20 by engaging both the weight 26 and the recess 22. In one embodiment, the fastener 30 may be a threaded bolt 30 which extends through the weight 26 and contacts the recess 22. In another exemplary embodiment, the fastener 30 may be a spring bolt, a cross section of a portion of which is illustrated in FIG. 7. The spring bolt 30 includes a compression portion 36 disposed in the center of a thread portion 34 of the spring bolt. The thread portion 34 is designed to compress when in contact with a receiving member 32 and thereby prevent the spring bolt 30 from turning freely in the weight 26.

The embodiments of the present invention are not limited to the particular formulations, process steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. A golf club head of the wood-type, comprising:

a body comprising a ball-striking face, a sole, a crown, and a u-shaped ribbon disposed on the sole and extending rearwardly from the face;

a u-shaped elongated groove that extends along a portion of the ribbon, the elongated groove defining a series of continuous recesses disposed on an inner surface of the elongated groove, the elongated groove comprising a series of connected portions defining a multi-dimensional track;

one or more weights slidably disposed in the elongated groove and configured to slidably engage the multi-dimensional track so the one or more weights are slidably retained in the groove and slide about the multi-dimensional track and engage one of the recesses.

2. The golf club head of claim 1, further comprising a fastener affixed to the one or more weights capable of selectively fixing a location of the weights, wherein the series of recesses disposed on the inner surface are operable to receive the fastener.

3. The golf club head of claim 1, the series of connected portions defining the multi-dimensional track comprising two opposing, spaced apart portions extending away from each other toward the ball-striking face.

4. The golf club head of claim 1, the series of connected portions defining the multi-dimensional track comprising a middle portion that connects the two opposing, spaced apart portions to form a continuous elongated groove.

5. The golf club head of claim 1, wherein the multi-dimensional track is configured so that the one or more weights disposed in the track can be moved in a first dimension between the ball-striking face and a back portion of the club and in a second dimension between a toe portion and a heel portion of the club.

6. The golf club head of claim 1, the series of continuous recesses comprising surfaces to receive a fastener associated with the one or more weights, wherein the surfaces are equally spaced apart along the recess.

7. The golf club head of claim 1, wherein the elongated groove has a dovetail shape and the one or more weights have a complementary shape enabling the elongated groove to hold the one or more weights in the groove.

8. The golf club head of claim 1, further comprising a receiving slot operable to receive the one or more weights and insert the one or more weights into the elongated groove, the receiving slot being located at a location along the elongated groove that is proximate a heel portion of the club.

9. The golf club head of claim 8, further comprising a removable stop disposed in the receiving slot that prevents the one or more weights from leaving the elongated groove.

10. A golf club head of the wood-type, comprising:

a body defining an interior cavity and including a ball-striking face, a sole, a crown, and a general v-shape ribbon disposed on the sole and to the rear of the ball-striking face;

an elongated u-shaped groove disposed on a portion of the ribbon, the elongated groove including a plurality of continuous recesses disposed on an inner surface of the elongated groove, the elongated groove comprising extension portions having ends that extend away from each other toward the ball-striking face and are separated by the sole; and the elongated groove configured to carry one or more weights in slidable arrangement so that the one or more weights can be disposed and slidably retained in the elongated groove and to receive the one or more weights in a unique one of the continuous recesses so that placement of the one or more weights along the groove enables adjustment of mass properties of the club.

11. The golf club of claim 10, further comprising a fastener affixed to each of the one or more of weights, the fastener comprising an end portion configured to be received into the continuous recesses such that a location of the weights can be fixed along the elongated groove.

12. The golf club of claim 10, the elongated groove comprising a joining section to join the extension portions, the joining section disposed at a location away from the ball-striking face and near a heel section of the golf club.

13. The golf club of claim 10, the elongated groove being configured as a multi-dimensional track configured to allow placement of the weights in a first dimension between the ball-striking face of the club and a back portion of the club and in a second dimension between a heel portion and a toe portion of the club.

14. The golf club of claim 10, the plurality of continuous recesses being spaced evenly along the elongated groove at discrete locations and comprise opposing wall surfaces enabling placement of the one or more weights at the discrete locations.

15. The golf club of claim 10, the plurality of continuous recesses being positioned at discrete locations in the groove and configured to receive fasteners associated with the one or more weights such that placement of the one or more weights remains constant when fastened in the plurality of recesses.

16. The golf club of claim 10, wherein the elongated groove and the one or more weights are configured with corresponding shapes so that the elongated groove can carry the one or more weights and the one or more weights can slidably traverse corner portions of the elongated groove.

17. In a golf club head having a body defining a ball-striking face, a sole, a crown, and a ribbon portion, an adjustable weight golf club system configured to enable a user to adjust position of one or more weights disposed proximate the ribbon portion to adjust mass properties of the golf club, the adjustable weight golf club system comprising:

one or more weights;

a groove generally positioned proximate a ribbon portion of a golf club and extending along at least a portion of the ribbon;

the groove comprising opposed groove walls and a groove inner surface, the groove walls configured to extend from the groove inner surface to define a groove opening;

a plurality of recesses disposed in the groove and located on the groove inner surface, each of the recesses comprising opposing sloped walls; and the groove configured to carry the at least one weight adapted for lockable engagement with a unique one of the plurality of recesses so that a user can lockably position the at least one weight along the groove to adjust mass properties of the golf club.

18. The adjustable weight golf system of claim 17, the groove being configured as a multidimensional track so that the at least one weight in the track can be positioned at a location along a first dimension between ball-striking face and back portions of the golf club and along a second dimension between hell and toe portions of the golf club.

19. The adjustable weight golf club system of claim 17, wherein the plurality of recesses are spaced evenly along the groove and configured to position the at least one weight at a predetermined position in the elongated groove.

20. The adjustable weight golf club system of claim 17, wherein the at least one weight is sized and shaped to have a complimentary cross section as the groove, the at least one weight having opposed ends extending toward the opposed groove walls to snugly fit within the groove.

* * * * *